US011346202B2

(12) United States Patent
Brumbaugh et al.

(10) Patent No.: US 11,346,202 B2
(45) Date of Patent: May 31, 2022

(54) DRILL BIT SUBSYSTEM FOR AUTOMATICALLY UPDATING DRILL TRAJECTORY

(71) Applicant: LANDMARK GRAPHICS CORPORATION, Houston, TX (US)

(72) Inventors: Greg Daniel Brumbaugh, Houston, TX (US); Youpeng Huang, Houston, TX (US); Janaki Vamaraju, Austin, TX (US); Joseph Blake Winston, Houston, TX (US); Aimee Jackson Taylor, Bogota (CO); Keshava Rangarajan, Sugar Land, TX (US); Avinash Wesley, New Caney, TX (US)

(73) Assignee: Landmark Graphics Corporation, Houston, TX (US)

( * ) Notice: Subject to any disclaimer, the term of this patent is extended or adjusted under 35 U.S.C. 154(b) by 0 days.

(21) Appl. No.: 16/968,705

(22) PCT Filed: Jun. 27, 2018

(86) PCT No.: PCT/US2018/039718
§ 371 (c)(1),
(2) Date: Aug. 10, 2020

(87) PCT Pub. No.: WO2020/005225
PCT Pub. Date: Jan. 2, 2020

(65) Prior Publication Data

US 2020/0378236 A1 Dec. 3, 2020

(51) Int. Cl.
*E21B 44/02* (2006.01)
*E21B 7/06* (2006.01)
(Continued)

(52) U.S. Cl.
CPC ..... *E21B 44/02* (2013.01); *E21B 7/064* (2013.01); *E21B 47/00* (2013.01); *E21B 47/026* (2013.01);
(Continued)

(58) Field of Classification Search
CPC ..... E21B 44/00; E21B 44/005; E21B 44/02; E21B 44/04; E21B 45/00; E21B 47/00; E21B 47/026; E21B 47/04
See application file for complete search history.

(56) References Cited

U.S. PATENT DOCUMENTS 5,812,068 A * 9/1998 Wisler ..... E21B 47/022 340/855.5
7,359,844 B2 4/2008 Sung et al.
(Continued)

OTHER PUBLICATIONS

International Application No. PCT/US2018/039718, "International Search Report and Written Opinion", dated Mar. 14, 2019, 11 pages.

*Primary Examiner* — Tara Schimpf
(74) *Attorney, Agent, or Firm* — Kilpatrick Townsend & Stockton LLP

(57) ABSTRACT

A drill bit subsystem can include a drill bit, a processor, and a non-transitory computer-readable medium for storing instructions and for being positioned downhole with the drill bit. The instructions of the non-transitory computer-readable medium can include a machine-teachable module and a control module that are executable by the processor. The machine-teachable module can receive depth data and rate of drill bit penetration from one or more sensors in a drilling operation, and determine an estimated lithology of a formation at which the drill bit subsystem is located. The control module can use the estimated lithology to determine an updated location of the drill bit subsystem, and control a direction of the drill bit using the updated location and a drill plan.

20 Claims, 5 Drawing Sheets

(51) Int. Cl.

| | |
|---|---|
| ***E21B 47/04*** | (2012.01) |
| ***E21B 47/00*** | (2012.01) |
| ***E21B 47/026*** | (2006.01) |
| *E21B 44/04* | (2006.01) |

(52) U.S. Cl.
CPC ..... *E21B 47/04* (2013.01); *E21B 44/04* (2013.01); *E21B 2200/22* (2020.05)

(56) References Cited

U.S. PATENT DOCUMENTS

| | | | | |
|---|---|---|---|---|
| 2007/0185696 | A1 | 8/2007 | Moran et al. | |
| 2010/0314173 | A1 | 12/2010 | Hbaieb et al. | |
| 2013/0118807 | A1 | 5/2013 | Yang | |
| 2014/0116776 | A1 | 5/2014 | Marx et al. | |
| 2015/0300151 | A1* | 10/2015 | Mohaghegh | E21B 47/10 702/9 |
| 2015/0369031 | A1 | 12/2015 | Yang et al. | |
| 2016/0084061 | A1 | 3/2016 | McHugh et al. | |
| 2017/0058658 | A1 | 3/2017 | Spencer et al. | |
| 2018/0094518 | A1* | 4/2018 | Kpetehoto | E21B 44/02 |
| 2019/0345809 | A1* | 11/2019 | Jain | E21B 21/08 |
| 2020/0040719 | A1* | 2/2020 | Maniar | E21B 44/00 |

* cited by examiner

DRILL BIT SUBSYSTEM FOR AUTOMATICALLY UPDATING DRILL TRAJECTORY

TECHNICAL FIELD

The present disclosure relates generally to wellbore drilling. More specifically, but not by way of limitation, this disclosure relates to using a drill bit subsystem downhole for controlling drill bit trajectory.

BACKGROUND

Wellbore drilling operations are performed with limited knowledge of a formation's lithology. Wellbore drilling can be a slow process due to unexpected changes in lithology, which can cause problems such as well kicks. Although downhole sensors are able to obtain information about a downhole environment during a drilling operation, there is a communication delay between that information being received at a surface, interpreted, and commands being transmitted to control the drill bit downhole. The delay can result in positional lags between information and controls from the surface to the drill bit. For example, the drill bit may be 30 feet, 90 feet, or more past the position corresponding to where data was obtained that is used to control the drill bit.

DETAILED DESCRIPTION

Figure 1:
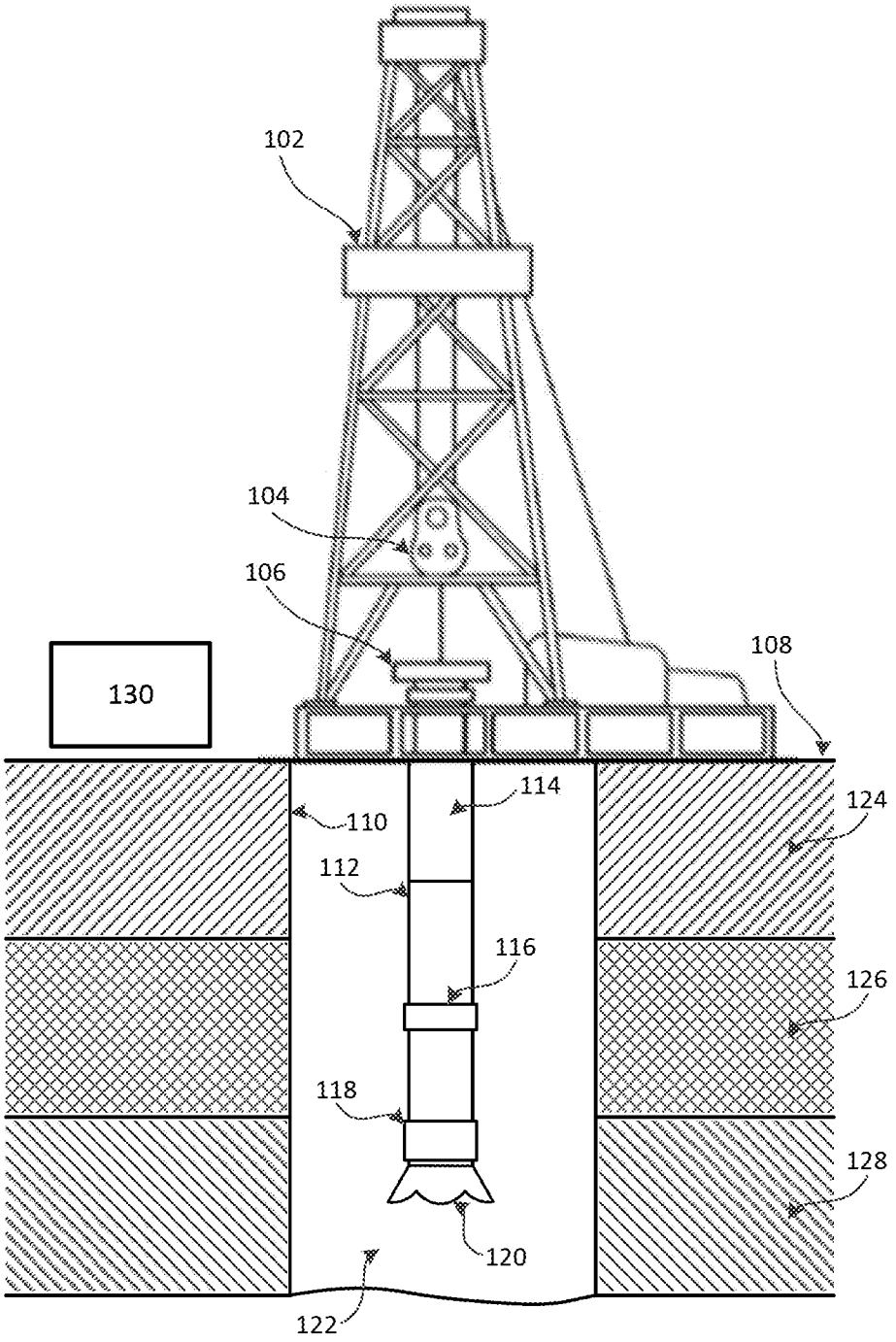
FIG. 1 is a schematic of an example of a well system that includes a drill bit subsystem for automatically updating drill bit trajectories according to one aspect of the disclosure.

Certain aspects and features of the present disclosure relate to using a drill bit subsystem in a wellbore for automatically updating drill bit trajectory. The drill bit subsystem can receive a planned trajectory of the drill bit, a relative lithology model, wellbore environment parameters, and drill bit operating parameters for actively locating and automatically directing the drill bit subsystem within a formation. The drill bit subsystem can gather information from within the wellbore environment using tools and sensors in the drill string, determine the location of the drill bit within the lithology, compare that determined location against a drill plan, and then adjust the direction and drill rate of a drill bit to reach a target.

The drill bit subsystem can fully automate drilling operations performed and executed downhole and at the surface including geosteering and kelly bushing. The drill bit subsystem can manage mud-telemetry communication with the surface to transceive signals with motors downhole, transmit requests to drillers and mud engineers at the surface, and transmit drilling progress updates to the surface. Automating the drilling process can eliminate the need for manual input by engineers or operators at the surface of the wellbore, and therefore can eliminate the need to provide data to the surface for decision-making purposes. Locating the decision-making components of the drill bit subsystem down in the wellbore can eliminate the need to provide data to the surface for decision-making purposes but reduce estimated drill time compared to non-automated processes. The drill bit subsystem can detect certain environmental conditions with the wellbore, such as well kicks, much sooner and can deploy responsive actions to remedy these situations without waiting for a surface-issued command. As a result, the drill bit subsystem can save operators days of rig time and remove a great deal of risk to personnel.

In some examples, the drill bit subsystem can autonomously locate and geosteer a drill bit accurately to within a few feet of the targeted endpoint within a formation by identifying transitions between different layers of formation material. The drill bit subsystem can result in more accurately drilled wells, improving overall production. Faster layer identification can result in wells being drilled faster and safer. With greater accuracy of drilling operations, reservoir drilling can be further optimized, resulting in fewer wells drilled.

A drill plan can include a planned trajectory through a formation and a planned endpoint of the drill bit within a formation. The formation can be any subsurface lithology including at least one layer through which the drill bit subsystem can traverse. The drill plan can include information relating to the basin being drilled, which may include lithology measurements gathered from surrounding wellbores. The drill plan can be stored in the drill bit subsystem, which can allow the drill bit subsystem to compare the real-time location of the drill bit against the drill plan for adjusting the current drill bit location to more accurately align with and follow the projected drill plan path.

In certain examples, the drill bit subsystem can include a machine-teachable module housed downhole with other measurement while drilling ("MWD") or logging while drilling ("LWD") suites and steerable bit hardware to create an optimized autonomous self-drilling tool. The machine-teachable module can combine Decision Space software suites (e.g., Automated Activity/Rig State Detection Service, Automated Lithology Detection with Formation Interpretation, 'Basic' Pore Pressure and Fracture Gradient Model and RT Update) with an earth model and trajectory to determine an estimated lithology and location of the drill bit in real time. The machine-teachable module can receive information from one or more sensors including depth data and rate of drill bit penetration. The machine-teachable module can determine an estimated lithology of a formation at which the drill bit subsystem is located, which may be determined by analyzing information including the depth data and rate of drill bit penetration.

In some examples, the lithology of a formation may differ significantly from the anticipated lithology described by the drill plan. For example, a drill plan may describe a lithology as including alternating layers of limestone and claystone throughout a certain depth range, but the drill bit subsystem and accompanying sensors detect and estimate that the lithology corresponding to that depth range includes only limestone. In this example where the drill plan departs from the estimated lithology, the control module can update the drill plan with the estimated lithology to reflect the actual lithology of a specific wellbore more accurately. Updated drill plans can be used in conjunction with other measurements taken from the surrounding wellbore within the same basin or area to refine the ability of the machine-teachable module to determine an estimated lithology.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 depicts a well system that includes a drill bit subsystem 118 for automatically updating drill trajectory within a wellbore 110 according to one example. The well system 102 can include a wellbore 110 extending through various earth strata including the layers 124, 126, 128. The wellbore 110 extends through layers 124, 126, 128, which can each have distinguishable physical characteristics representing material differences in each layer. A sensor 116 and the drill bit subsystem 118 including a drill bit 120 can be coupled to a drillstring 114 (e.g. wireline, slickline, or coiled tube) that can be deployed into or retrieved from the wellbore 110, for example, using a winch 104. The drillstring 114 extends from the surface 108 through the layers 124, 126, 128. The drill bit subsystem 118 can be used to determine transitions between the layers 124, 126, 128, and can be used to determine the location of the drill bit 120 within the lithology with respect to the layers 124, 126, 128.

The wellbore 110 may be created by drilling into layers 124, 126, 128 using the drillstring 114. A wellbore drill assembly 112 can be driven and can be positioned or otherwise arranged at the bottom of the drillstring 114 extended into the wellbore 110 from a derrick 106 arranged at the surface 108. The derrick 106 can include the winch 104 used to lower and raise the drillstring 114. The drillstring 114, using winch 104, can be used to retrieve the sensor 116 and the drill bit subsystem 118 including drill bit 120 from within the wellbore drill assembly 112. The wellbore drill assembly 112 can include the sensor 116 and the drill bit subsystem 118 including drill bit 120 operatively coupled to the drillstring 114, which may be moved axially within a drilled wellbore 110 as attached to the drillstring 114. The drill bit subsystem 118 can be used to autonomously direct the trajectory of the drill bit 120 through the layers 124, 126, 128.

The wellbore 110 can include fluid 122. The fluid 122 can flow in an annulus positioned between the wellbore drill assembly 112 and a wall of the wellbore 110. The wellbore drill assembly 112 may include more than one sensor usable for measuring various conditions within the wellbore 110. In some examples, the fluid 122 can contact the sensor 116. Contact of the fluid 122 with the sensor 116 can allow the sensor 116 to measure conditions within the wellbore. Additionally, the sensor 116 may perform measurements related to the wellbore drill assembly 112. The sensor 116 can be used to capture data about the wellbore environment in a LWD/MWD configuration.

The sensor 116 can be communicatively coupled to the drill bit subsystem 118 for communicating data captured about the wellbore environment usable for estimating the location of and determining the environmental conditions around the drill bit 120 in real time. The sensor 116 can be communicatively coupled to a communications device 130 located at the surface 108 for communicating data captured about the wellbore environment usable for conventional drilling methodologies. The communications device 130 can be communicatively coupled to the drill bit subsystem 118 for communicating information about the drill bit subsystem 118 to the surface 108 and for issuing commands from the surface 108 to the drill bit subsystem 118. The communications device 130 can be connected to any local or wide area networks or other communications infrastructure for communicating data related to the trajectory or location of the drill bit subsystem 118 outside the well system 102 environment.

In some examples, the drill bit subsystem 118 can be overridden by commands issued from the surface 108. The communications device 130 may issue an override command to the drill bit subsystem 118 to cease autonomous drilling by the drill bit subsystem 118 and to prioritize commands issued at the surface 108 for performing any conventional wellbore drilling processes. Operations conducted by the machine-teachable module and the control module for autonomously controlling the trajectory of the drill bit subsystem 118 can be halted after receiving a command or set of commands issued from the surface 108 by a wellbore operator or wellbore control mechanism (e.g., safety override, manual shut down, computer-implemented process for switching to conventional drilling methods). Once operation of the autonomous drill bit subsystem ceases, the wellbore operator or other control mechanism can operate the wellbore drilling environment according to any conventional drilling methods. Similarly, the drill bit subsystem 118 for autonomously drilling and updating the drill bit trajectory can be reinitiated by executing a similar command from the surface. The drill bit subsystem 118 may include user-defined limitations to cease operation after a certain period of time or after drilling a certain depth (i.e. time-out limit), or to reinitiate operation after a certain period of time that may be idle time (i.e. time-in limit). Though such user-defined time-out and time-in limitations may stagger drilling operations, they may help wellbore operators effectively and safely operate the wellbore drilling environment by reducing the number of user-issued commands from the surface 108 while maintaining the benefits of autonomously updating the drill bit trajectory.

Figure 2:
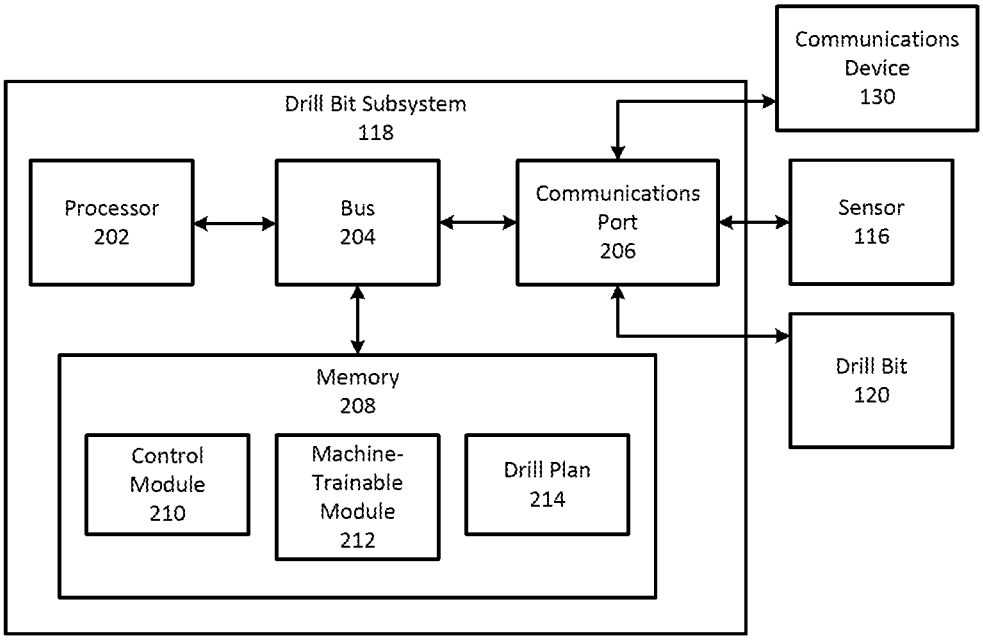
FIG. 2 is a block diagram of an example of a drill bit subsystem usable for automatically updating drill bit trajectories downhole according to one aspect of the disclosure.

FIG. 2 is a block diagram of an example of a drill bit subsystem 118 usable for automatically updating drill bit trajectories downhole according to one example. The drill bit subsystem 118 can include a processor 202, a bus 204, a communications port 206, and a memory 208. In some examples, the components shown in FIG. 2 (e.g., the processor 202, the bus 204, the communications port 206, the memory 208) can be integrated into a single structure. For example, the components can be within a single housing. In other examples, the components shown in FIG. 2 can be distributed (e.g., in separate housings) and in electrical communication with each other.

The processor 202 can execute one or more operations for implementing some examples. The processor 202 can execute instructions stored in the memory 208 to perform the operations. The processor 202 can include one processing device or multiple processing devices. Non-limiting examples of the processor 202 include a Field-Programmable Gate Array ("FPGA"), an application-specific integrated circuit ("ASIC"), a microprocessor, etc.

The processor 202 can be communicatively coupled to the memory 208 via the bus 204. The non-volatile memory 208 may include any type of memory device that retains stored information when powered off. Non-limiting examples of the memory 208 include electrically erasable and programmable read-only memory ("EEPROM"), flash memory, or any other type of non-volatile memory. In some examples, at least some of the memory 208 can include a medium from which the processor 202 can read instructions. A computer-readable medium can include electronic, optical, magnetic, or other storage devices capable of providing the processor 202 with computer-readable instructions or other program code. Non-limiting examples of a computer-readable medium include (but are not limited to) magnetic disk(s), memory chip(s), ROM, random-access memory ("RAM"), an ASIC, a configured processor, optical storage, or any other medium from which a computer processor can read instructions. The instructions can include processor-specific instructions generated by a compiler or an interpreter from code written in any suitable computer-programming language, including, for example, C, C++, C #, etc.

The memory 208 can include program code for a control module 210, a machine-teachable module 212, and a drill plan 214. The drill plan 214 can store the drilling plan data that the control module 210 can compare the estimated lithology against for determining an updated location of the drill bit subsystem 118 or drill bit 120. The drill plan 214 can be updated by the control module 210 when the updated location of the drill bit 120 differs significantly from the drill plan 214.

The machine-teachable module 212 can (i) receive data from the sensor 116 via the communications port 206 and (ii) teach a lithology estimation model according to some examples. The control module 210 can (i) determine an updated location of the drill bit subsystem 118 and drill bit 120 using the lithology estimation model provided by the machine-teachable module 212 and (ii) control the trajectory of the drill bit 120 using the updated location according to some examples. In some examples, the sensor 116 can be included in the housing of the drill bit subsystem 118 for measuring operating parameters internal to the drill bit subsystem 118.

In certain examples, the control module 210 can utilize the estimated lithology at which the drill bit 120 is located to determine an updated location of the drill bit 120. The estimated lithology can be determined by the machine-teachable module 212. The control module 210 can update the location of the drill bit 120 with respect to the estimated lithology, identifying the location of the drill bit 120 within three-dimensional space. The control module 210 can compare the updated location of the drill bit 120 against the drill plan 214 to determining whether any discrepancies exist. If the projected location of the drill bit 120 according to the drill plan 214 varies or departs from the determined updated location, the control module 210 can control the direction and operating parameters of the drill bit 120 via the communications port 206 for readjusting the real-time trajectory of the drill bit 120. This process can be repeated throughout the drilling and logging process such that the drill bit subsystem 118 can constantly readjust the drilling parameters and trajectory to match the planned trajectory provided by the drill plan 214 as closely as possible. In some examples, the control module 210 can have a preset trajectory defined by the drill plan 214 or by commands issued from the surface of the wellbore environment. In examples where the actual real-time trajectory of the drill bit 120 does not depart from the drill plan 214, the control module 210 may not need to readjust the trajectory of the drill bit 120 based on the estimated lithology. The control module 210 can control any processes necessary for implementing any conventional method of drilling. In some examples, the drill bit subsystem 118 and drill bit 120 can be located proximate to each other or can be affixed to each other, such that determining the location of the drill bit 120 within the lithology by the control module 210 can correspond to determining the location of the drill bit subsystem 118. In other examples, the drill bit 120 can be a component of the drill bit subsystem 118.

In some examples, the control module 210 and machine-teachable module 212 can be located in systems other than the drill bit subsystem 118, where such systems can be communicatively coupled to the drill bit subsystem 118 via the communications port 206. For example, the machine-teachable module 212 may be located at the surface 108 and may include a memory, a processor, a bus, and a communications port separate from the components of the drill bit subsystem 118 located within the wellbore 110. For further example, the control module 210 may be positioned at a distance from the drill bit subsystem 118 and proximate to the drill bit 120, and may include a memory, a processor, a bus, and a communications port separate from the components of the drill bit subsystem 118.

Figure 3:
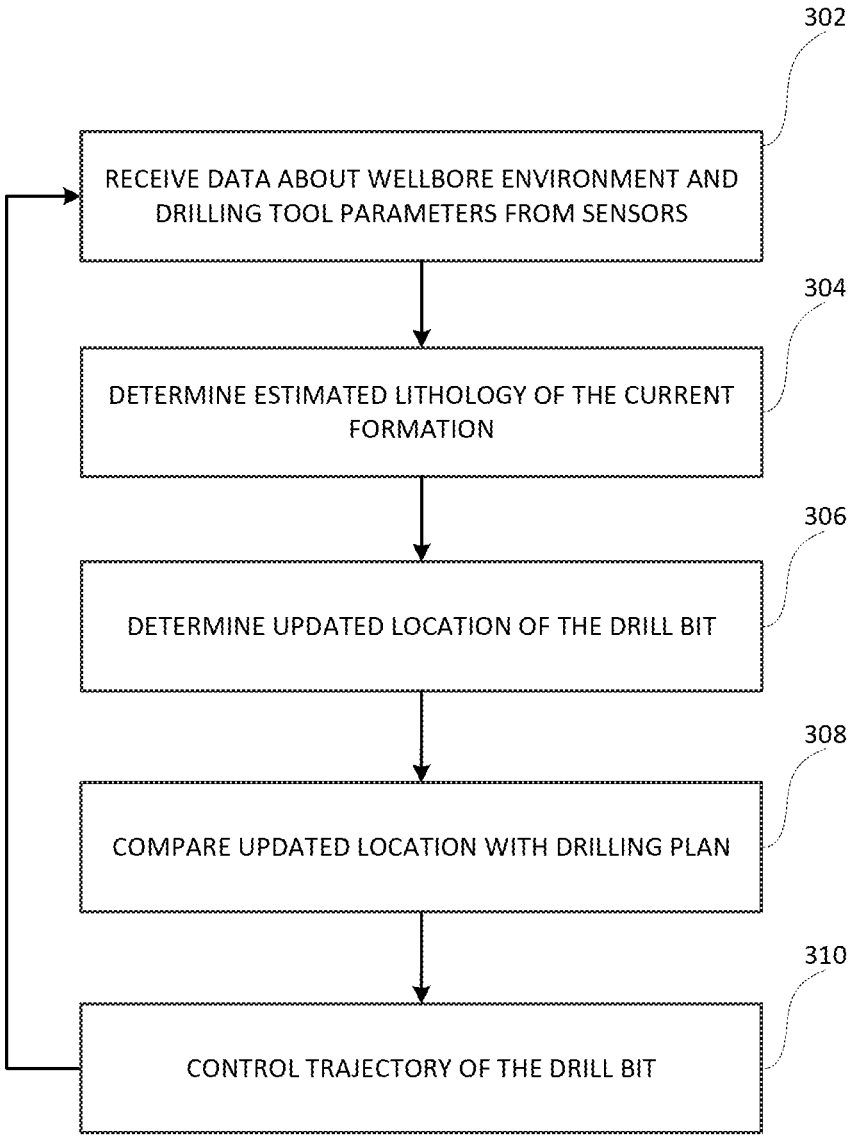
FIG. 3 is a flowchart of a process for using a drill bit subsystem for automatically updating drill bit trajectories according to one aspect of the disclosure.

FIG. 3 is a flowchart describing a process for using a drill bit subsystem 118 for automatically updating drill bit trajectories according to one example. The blocks depicted in FIG. 3 can be executed in real time during other MWD/LWD operations.

At block 302, the drill bit subsystem 118 receives wellbore environment from at least one sensor 116 and drilling tool parameters. The sensors communicatively coupled to the drill bit subsystem 118 via the communications port 206 can transmit information about the wellbore environment, including basin data, to the machine-teachable module 212 for developing an estimated lithology model. The sensor data can include any parameters about the current wellbore drilling operation that would be pertinent to determining an estimated lithology, including depth data, rate of drill bit penetration, revolution per minute rate of the drill bit, drill bit diameter, and weight on the drill bit. These parameters can also be determined by internal sensors of the drill bit subsystem 118, in which the operating parameters of the drill bit 120 are observed and recorded. Sensor data can be continuously received by the drill bit subsystem 118 from one or more sensors at any time during the processes described in FIG. 3.

At block 304, the drill bit subsystem 118 determines an estimated lithology via the machine-teachable module 212. The drill bit subsystem 118 can use the wellbore environment and drilling parameter data received in block 302 to determine an estimated lithology of a formation at which the drill bit subsystem 118 is located. The machine-teachable module 212 can develop an estimated lithology model according one example described by FIG. 5, particularly by blocks, 504, 506, and 508. Applying the estimated lithology model to the current wellbore along with any associated environmental attributes and recorded drilling parameters can produce an estimated lithology of the formation. The estimated lithology can describe the anticipated lithology of the formation in which the wellbore is being drilled prior to validating the lithology by actually drilling the wellbore. In examples where the estimated lithology has already been predicted for a specific environment, the estimated lithology model can be further refined by considering additional variables including drill tool parameters and other wellbore environment data in real time as the drill bit subsystem 118 and drill bit 120 traverses through the formation. Actively refining the estimated lithology model throughout the drilling process can produce a more accurate estimated lithology in which the drill bit subsystem 118 can use to better locate the estimated location of the drill bit 120 in three-dimensional space.

At block 306, the drill bit subsystem 118 determines the updated location of the drill bit 120 using the estimated lithology of the formation. The drill bit subsystem 118 can use the estimated lithology of the formation determined in block 304 to determine the location of the drill bit 120 in real time during drilling operations. By assessing certain parameters including depth rate and rate of drill bit penetration, the drill bit subsystem 118 can determine the current location of the drill bit 120 with respect to the estimated lithology. For example, an estimated lithology of a formation may anticipate 100 feet of limestone immediately above 100 feet of claystone. The drill bit subsystem can expect to be drilling through claystone at 120 feet, the depth of which can be determined by analyzing the drilling parameters and other sensory information. The drill bit subsystem 118 can update the location of the drill bit 120 within the memory 208. Updating the locating of the drill bit subsystem 118 and drill bit 120 in three-dimensional space can be actively performed in real time throughout the drilling process.

At block 308, the drill bit subsystem 118 compares the updated location of the drill bit 120 within the wellbore against a corresponding drill plan. The drill bit subsystem 118 can use the drill plan 214 to assess whether the drill bit 120 is on course to reach the targeted endpoint within the wellbore. The drill bit subsystem 118 can compare the updated location determined in block 306, which describes the current location of the drill bit 120 in three-dimensional space within a formation, against the drill plan 214, which includes a planned trajectory of the drill bit 120 within the formation. In some examples, if the updated location of the drill bit subsystem 118 differs significantly from the drill plan, the control module 210 can update the drill plan to reflect the actual lithology of the formation more accurately. Updating the drill plan to reflect the actual lithology in which the wellbore is drilled can help reduce error in the current drilling operation and subsequent drilling operations including drilling additional surrounding wellbores within the same formation.

At block 310, the drill bit subsystem 118 controls the trajectory of the drill bit 120 in response to the comparison of the updated location with the corresponding drill plan. In examples where the comparison between the updated location of the drill bit 120 and the drill plan produces no difference (i.e. the drill bit 120 is on the correct drill plan course to reach the destination), the control module 210 need not make adjustments to the trajectory of the drill bit 120. In examples where the comparison between the updated location of the drill bit 120 and the drill plan produces a difference (i.e. the drill bit 120 is not on the correct drill plan course to reach the destination), the control module 210 can make adjustments to the trajectory to guide the drill bit 120 back to the desired course. Adjustments issued from the control module 210 for changing the trajectory of the drill bit 120 can include stopping the drilling process, changing the revolutions per minute rate of the drill bit 120, changing direction, and changing the weight on the drill bit 120. The control module 210 can interact with any conventional downhole tools or hardware components in order to change the trajectory of the drill bit 120. The control module 210 can also issue commands to the communications device 130 via the communications port 206 for instructing wellbore operators to make adjustments to the drilling process that can only be executed at the surface. After an adjustment to the trajectory of the drill bit 120 is performed, the processes described in FIG. 3 can be repeated, allowing the drill bit subsystem 118 to continuously and autonomously update the trajectory of the drill bit 120 in real time so that the drill bit 120 may reach the desired endpoint within the formation with as little error as possible.

In some examples, the drill bit subsystem 118 can receive an override command to cease functioning so that conventional drilling methods can be implemented. An operator or computer-implemented control mechanism can issue an override command via the communications device 130 to the drill bit subsystem 118. The override command can include an instruction or a set of instructions to cease or alter autonomous drilling functions performed by the drill bit subsystem 118. A similar command can be issued by an operator or computer-implemented control mechanism to reinitiate the processes described by FIG. 3. In some examples, the drill bit subsystem 118 can receive a command from the surface while performing the processes described in FIG. 3, perform the received command, and continue operations for autonomously controlling the trajectory of the drill bit 120 without stoppage. For example, the drill bit subsystem 118 can receive a command from the surface while performing operations for autonomously controlling and updating the trajectory of the drill bit 120. The command can direct the drill bit subsystem 118 to adjust the trajectory of the drill bit 120 independent of any adjustments automatically made in block 510. The drill bit subsystem 118 can perform the commanded adjustment then continue autonomously controlling the trajectory without fully stopping the process.

Figure 4:
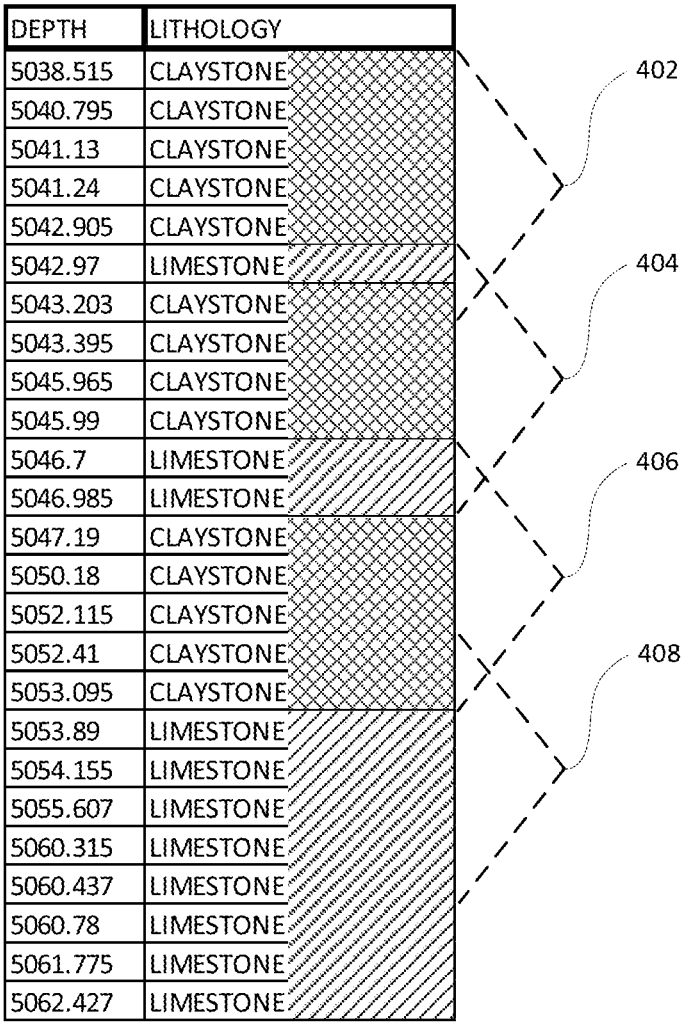
FIG. 4 is a diagram of a lithology for describing how a drill bit subsystem can determine a change in lithology downhole according to one aspect of the disclosure.

FIG. 4 is a diagram of a lithology for describing how the drill bit subsystem 118 determines a change in lithology downhole according to one example. Sample depths are depicted with corresponding formation types at each depth value. The drill bit subsystem 118 can identify a transition in a formation while drilling by calculating which formation type composes a majority within a range of depths. The drill bit subsystem 118 can identify a transition when the majority composition of a transition analysis range changes to a different majority composition in a subsequent transition analysis range. For example, the drill bit subsystem 118 at transition analysis range 402 can analyze the composition of each respective layer within the transition analysis range 402 and determine the most common formation type. In this example, the majority formation type within transition analysis range 402 is claystone, despite one layer within the range being limestone. The drill bit subsystem 118 can reach transition analysis ranges 404, 406 in which the majority composition remains claystone, and will therefore not detect or identify a transition in the lithology of the formation. At transition analysis range 408, the drill bit subsystem 118 can detect that the average composition of the formation is limestone, and can identify a transition point at the first layer corresponding to the majority material (e.g., the transition point as depicted in FIG. 4 is located at depth 5053.89).

In some examples, estimating a lithology can include determining the entrance and the exit points of a specific type of a formation, where that formation has discernable characteristics from formation layers immediately above and below the type of formation. For example, a formation of limestone may be preceded, in terms of drill bit penetration order, by a deposit or layer of claystone, and followed by a subsequent layer or deposit of claystone. In this example, the claystone layers surrounding the limestone formation have discernable characteristics and varying lithology, such that limestone and claystone are drilled at different rates (e.g., limestone has a different density than claystone, which can correlate to a different rate of drill bit penetration). The machine-teachable module 212 of the drill bit subsystem can determine the entrance and the exit of a type of formation in response to a change in depth data, rate of drill bit penetration, or other sensory data received from one or more sensors in the drilling environment. Detecting changes in types of formations by determining the entrance and exits points of a particular formation can allow the drill bit subsystem to more accurately identify an estimated lithology in real-time. In some examples, the machine-teachable module can receive a revolution per minute rate of the drill bit, drill bit diameter, and weight on the drill bit, in addition to the rate of drill bit penetration and depth data, from one or more sensors within the drilling environment. These parameters can be used as additional inputs to the machine-teachable module to more accurately determine the estimated lithology of a formation at which the drill bit 120 is located.

Figure 5:
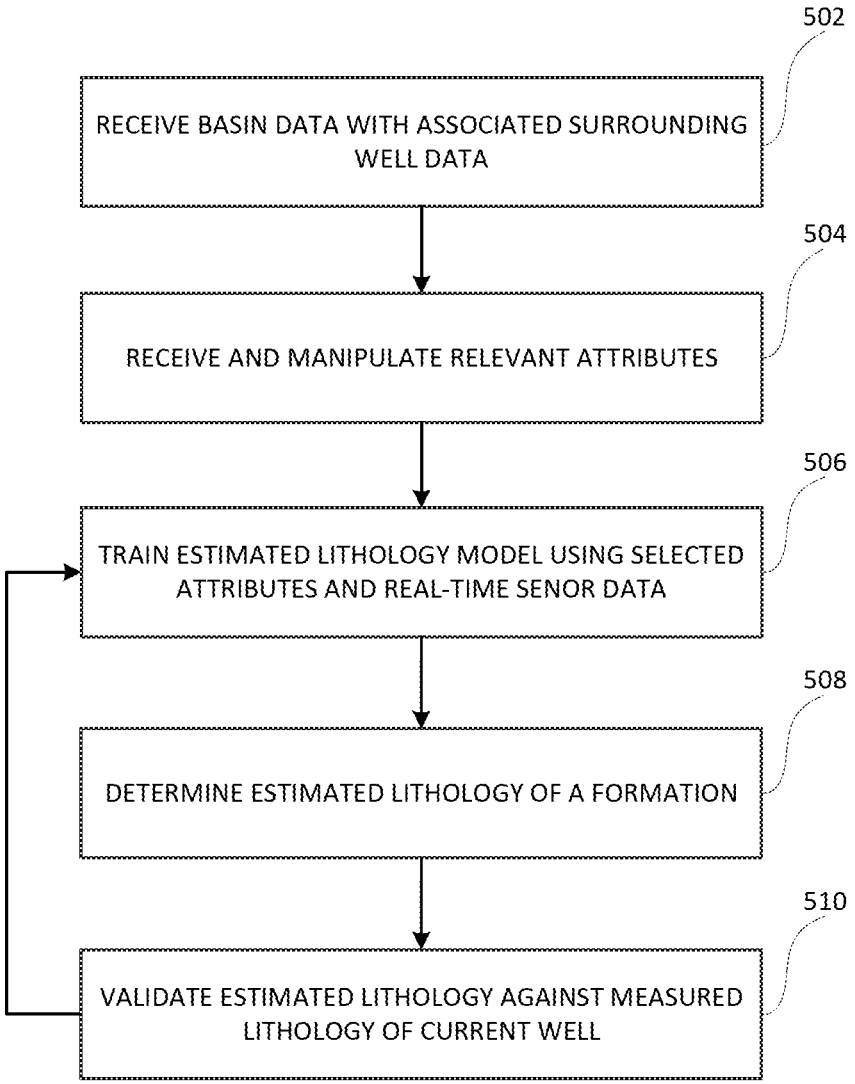
FIG. 5 is a flowchart of a process for determining an estimated lithology of a formation at which a drill bit subsystem is located according to one aspect of the disclosure.

FIG. 5 is a flowchart describing a process for determining an estimated lithology of a formation at which the drill bit subsystem 118 is located according to one example. In some aspects, the machine-teachable module 212 can be taught to estimate a lithology of a formation. In some examples, the processes described in FIG. 5 can be implemented using a neural network. In some examples, the process described in FIG. 5 can be performed by the drill bit subsystem 118 in real time while located within the wellbore during other MWD/LWD operations.

At block 502, the machine-teachable module 212 receives basin data including lithology measurements from surrounding wellbores. The machine-teachable module 212 can receive the basin data from the memory 208, in which basin data was previously stored within the drill bit subsystem 118, or from the communications device 130, where new basin data may be received by the communications port 206. A user can select an appropriate basin in which the current wellbore to be drilled is located for using the basin data as input to the machine-teachable module 212. The selected basin can be associated with wellbore data including lithology measurements derived from past-drilled wellbores within the selected basin. A wellbore currently being drilled in a basin can be expected to have a similar lithology of other wellbores drilled within that basin. Multiple lithology measurements derived from multiple past-drilled wellbores can be used to determine an average lithology common throughout the basin. The estimated lithology of a current wellbore can be more accurately determined as more wellbores are drilled, further validating the average lithology of the basin. In some examples, selecting the applicable basin and corresponding surrounding well data may be performed by an algorithm implemented in the drill bit subsystem 118.

At block 504, the machine-teachable module 212 receives and manipulates attributes relevant to determining an estimated lithology of a well system. The machine-teachable module 212 can receive the relevant attributes from the memory 208, in which the attributes were previously stored within the drill bit subsystem 118, or from the communications device 130, where new attributes may be received by the communications port 206. The relevant attributes can be transformed, filtered, and normalized in accordance with conventional data manipulation techniques to reformat data and fill in missing data points for using the data in the estimated lithology model. In some examples, a user can optimize the estimated lithology model by selecting the relevant attributes according to their overall effect in determining the estimated lithology model—attributes with little or no effect can be assigned less weight or excluded, while attributes with significant effect can be granted more weight. In other examples, selecting the appropriate attributes may be performed by an algorithm implemented in the drill bit subsystem 118.

At block 506, the machine-teachable module 212 builds and teaches the estimated lithology model using the relevant attributes selected and received in block 304 and real-time sensor data received from sensor 116. The machine-teachable module 212 can receive real-time sensor data from the sensor 116 via the communications port 206. The sensor data can include any parameters about the current wellbore drilling operation that would be pertinent to determining an estimated lithology, including depth data, rate of drill bit penetration, revolution per minute rate of the drill bit, drill bit diameter, and weight on the drill bit. The machine-teachable module 212 can use the wellbore drilling parameters measured by one or more sensors as inputs for building and teaching the estimated lithology model. The machine-teachable module 212 can use historical wellbore drilling parameter data to include as inputs for further refining the estimated lithology model. The estimated lithology model can be applied to the basin data received by the machine-teachable module 212 at block 302 to synchronize the estimated lithology model to the basin in which the current wellbore is being drilled.

In some examples, the machine-teachable module 212 can include an artificial neural network. Implementation of an artificial neural network can effectively increase the accuracy of the estimated lithology at which the drill bit subsystem 118 and drill bit 120 are located. A neural network can provide the machine-teachable module 212 with the ability to teach more complex estimation lithology models, simultaneously analyzing attributes of the present wellbore environment and additional wellbore environments and any associated inputs derived therefrom. The machine-teachable module 212 can implement various deep learning techniques including gradient boosting, recurrent neural networks, convolutional neural networks, and deep neural network stacks. The following equation can be used as a base in determining an estimated lithology prior to implementing a neural network for further refining the estimated lithology prediction produced by the machine-teachable module 212.

$$S = \sqrt{\frac{RPM \cdot WOB^2}{a \cdot f_c(P_e) \cdot ROP \cdot D_{bit}^3} - \frac{b \cdot WOB^2}{a \cdot D_{bit}^4} - \frac{c \cdot \rho \cdot \mu \cdot RPM \cdot WOB^2}{a \cdot f_c(P_e) \cdot F_{jm} \cdot D_{bit}^2}}$$

In some examples, the neural network can be optimized by excluding less relevant variables and including more relevant variables. Oversaturating the neural network with extraneous or less important variables can result in less effective and less accurate estimated lithology models. Conversely, limiting the neural network to too few variables may result in a neural network that is unable to be taught properly. Therefore, proper selection of the most relevant variables can result in the most effective implementation of a neural network. For example, rock compressive strength is unique to each type of formation, and selecting attributes that are a function of rock compressive strength can lead to more effectively taught estimated lithology models. As a further example, depth-dependent attributes may not be considered for use in the neural network since attributes that are a function of depth alone are inconsistent indicators of the lithology of a formation. Selecting variables that have a stronger relationship with lithology over variables that do not can result in a more refined lithology estimation produced by the machine-teachable module 212.

At block 508, the machine-teachable module 212 predicts the lithology of a formation in which a wellbore is being drilled. Applying the estimated lithology model to the current basin can predict the estimated lithology of a formation being drilled within the basin. In order to predict the lithology of a formation being drilled in a different basin, the estimated lithology model can be applied to that different basin data in block 306, in addition to using the relevant attributes selected in block 304 corresponding to that new basin. The estimated lithology produced from applying the estimated lithology model to the current basin can be analyzed to identify projected transition zones. The projected transition zones identified by the machine-teachable module 212 can signify the depths at which the drill bit subsystem 118 would anticipate drilling through each respective zone.

At block 510, the machine-teachable module 212 validates the estimated lithology by comparing the projection against the actual measured lithology of the current well. In some examples, the drill bit subsystem 118, via sensor 116, can provide real-time drilling tool parameters and measurements to the machine-teachable module 212 during MWD/LWD operations to verify that the estimated lithology determined in block 508 matches the actual lithology of the current formation. Cuttings can be used in addition to drilling tool parameters to determine the actual lithology of the formation. In other examples, the estimated lithology determined in block 508 can be validated after the wellbore is drilled by identifying formation tops recorded by the drill bit subsystem 118 or any conventional device for determining lithology post drilling. In some examples, the estimated lithology model determined at block 506 can be actively refined during MWD/LWD operations, such that the lithology of a formation determined by analyzing drilling tool parameters can be used to refine the estimated lithology model continuously. The validated lithology measurements of a wellbore can be utilized in block 502 to update the respective basin data prior to applying the process described in FIG. 5 to subsequent drilling operations within the same basin system.

As used below, any reference to a series of examples is to be understood as a reference to each of those examples disjunctively (e.g., "Examples 1-4" is to be understood as "Examples 1, 2, 3, or 4").

In some aspects, systems, devices, and methods for using a drill bit subsystem downhole for controlling drill bit trajectory are provided according to one or more of the following examples:

Example 1 is a drill bit subsystem comprising: a drill bit; a processor; and a non-transitory computer-readable medium for storing instructions and for being positioned downhole with the drill bit, the instructions comprising: a machine-teachable module that is executable by the processor to: receive depth data and rate of drill bit penetration from one or more sensors in a drilling operation; and determine an estimated lithology of a formation at which the drill bit subsystem is located; and a control module that is executable by the processor to: use the estimated lithology to determine an updated location of the drill bit subsystem; and control a direction of the drill bit using the updated location and a drill plan.

Example 2 is the drill bit subsystem of example 1, wherein the estimated lithology includes an entrance and an exit with respect to a type of formation, the entrance being located at a first layer of the type of formation and proximate to a preceding type of formation, and the exit being located at a second layer of the type of formation and proximate to a subsequent type of formation, the preceding type of formation and subsequent type of formation having a different lithology than the type of formation.

Example 3 is the drill bit subsystem of example 2, wherein the machine-teachable module that is executable by the processor to determine an estimated lithology of a formation at which the drill bit subsystem is located is further executable to: determine the entrance and the exit of the type of formation in response to a change in depth data and rate of drill bit penetration received from the one or more sensors in the drilling operation.

Example 4 is the drill bit subsystem of example 1, wherein the non-transitory computer-readable medium includes instructions for the machine-teachable module to be executable to further: receive a revolution per minute rate of the drill bit, a drill bit diameter, and a weight-on-bit from the one or more sensors in the drilling operation; and use an artificial neural network.

Example 5 is the drill bit subsystem of example 1, wherein the non-transitory computer-readable medium includes instructions for the drill bit subsystem to operate downhole absent communicating with non-downhole systems.

Example 6 is the drill bit subsystem of example 1, wherein the instructions of the non-transitory computer-readable medium are executable to cause the processor to: receive, from a surface of the drilling operation, a set of instructions including an override command for preventing automated procedures from being performed by the machine-teachable module and the control module; and executing the set of instructions to manually control the direction the drill bit.

Example 7 is the drill bit subsystem of example 1, wherein the machine-teachable module is teachable prior to being utilized downhole using data stored in a system that is separate from the drill bit subsystem.

Example 8 is a non-transitory computer-readable medium for storing instructions and being positioned downhole with a drill bit, the instructions comprising: a machine-teachable module that is executable by a processor to: receive depth data and rate of drill bit penetration from one or more sensors in a drilling operation; and determine an estimated lithology of a formation at which a drill bit subsystem is located; and a control module that is executable by the processor to: use the estimated lithology to determine an updated location of the drill bit subsystem; and control a direction of the drill bit of the drill bit subsystem using the updated location and a drill plan.

Example 9 is the non-transitory computer-readable medium of example 8, wherein the estimated lithology includes an entrance and an exit with respect to a type of formation, the entrance being located at a first layer of the type of formation and proximate to a preceding type of formation, and the exit being located at a second layer of the type of formation and proximate to a subsequent type of formation, the preceding type of formation and subsequent type of formation having a different lithology than the type of formation.

Example 10 is the non-transitory computer-readable medium of example 9, wherein the machine-teachable module that is executable by the processor to determine an estimated lithology of a formation at which the drill bit subsystem is located is further executable to: determine the entrance and the exit of the type of formation in response to a change in depth data and rate of drill bit penetration received from the one or more sensors in the drilling operation.

Example 11 is the non-transitory computer-readable medium of example 8, wherein the non-transitory computer-readable medium includes instructions for the machine-teachable module to: receive a revolution per minute rate of the drill bit, a drill bit diameter, and a weight-on-bit from the one or more sensors in the drilling operation; use the revolution per minute rate of the drill bit, the drill bit diameter, and the weight-on-bit; and use an artificial neural network.

Example 12 is the non-transitory computer-readable medium of example 8, wherein the non-transitory computer-readable medium includes instructions for the drill bit subsystem to operate downhole absent communicating with non-downhole systems.

Example 13 is the non-transitory computer-readable medium of example 8, wherein the instructions are executable to cause the processor to: receive, from a surface of the drilling operation, a set of instructions including an override command for preventing automated procedures from being performed by the machine-teachable module and the control module; and executing the set of instructions to manually control the direction the drill bit.

Example 14 is a method comprising: receiving, by a machine-teachable module that is executed by a processor and positioned with a drill bit downhole, depth data and rate of drill bit penetration from one or more sensors in a drilling operation using the drill bit; determining, by the machine-teachable module, an estimated lithology of a formation at which a drill bit subsystem that includes the drill bit is located; using, by a control module that is executed by the processor and positioned with the drill bit downhole, the estimated lithology to determine an updated location of the drill bit subsystem; and controlling, by the control module, a direction of the drill bit using the updated location and a drill plan.

Example 15 is the method of example 14, wherein the estimated lithology includes an entrance and an exit with respect to a type of formation, the entrance being located at a first layer of the type of formation and proximate to a preceding type of formation, and the exit being located at a second layer of the type of formation and proximate to a subsequent type of formation, the preceding type of formation and subsequent type of formation having a different lithology than the type of formation.

Example 16 is the method of example 15, wherein determining an estimated lithology of a formation at which the drill bit subsystem is located further includes determining the entrance and the exit of the type of formation in response to a change in depth data and rate of drill bit penetration received from the one or more sensors in the drilling operation.

Example 17 is the method of example 14, further comprising: receiving, by the machine-teachable module, a revolution per minute rate of the drill bit, a drill bit diameter, and a weight-on-bit from the one or more sensors in the drilling operation; using the revolution per minute rate of the drill bit, the drill bit diameter, and the weight-on-bit; and using an artificial neural network.

Example 18 is the method of example 14, further comprising: operating the drill bit subsystem downhole absent communicating with non-downhole systems.

Example 19 is the method of example 14, further comprising: receiving, by the control module, a set of instructions including an override command from a surface of the drilling operation for preventing automated procedures from being performed by the machine-teachable module and the control module; and executing the set of instructions to manually control the direction the drill bit.

Example 20 is the method of example 14, wherein the machine-teachable module is teachable prior to being utilized downhole using data stored in a system that is separate from the drill bit subsystem.

Example 21 is a non-transitory computer-readable medium for storing instructions and being positioned downhole with a drill bit, the instructions comprising: a machine-teachable module that is executable by a processor to: receive depth data and rate of drill bit penetration from one or more sensors in a drilling operation; and determine an estimated lithology of a formation at which a drill bit subsystem is located; and a control module that is executable by the processor to: use the estimated lithology to determine an updated location of the drill bit subsystem; and control a direction of the drill bit of the drill bit subsystem using the updated location and a drill plan.

Example 22 is the non-transitory computer-readable medium of example 21, wherein the estimated lithology includes an entrance and an exit with respect to a type of formation, the entrance being located at a first layer of the type of formation and proximate to a preceding type of formation, and the exit being located at a second layer of the type of formation and proximate to a subsequent type of formation, the preceding type of formation and subsequent type of formation having a different lithology than the type of formation.

Example 23 is the non-transitory computer-readable medium of example 22, wherein the machine-teachable module that is executable by the processor to determine an estimated lithology of a formation at which the drill bit subsystem is located is further executable to: determine the entrance and the exit of the type of formation in response to a change in depth data and rate of drill bit penetration received from the one or more sensors in the drilling operation.

Example 24 is the non-transitory computer-readable medium of any of examples 21 to 23, wherein the non-transitory computer-readable medium includes instructions for the machine-teachable module to: receive a revolution per minute rate of the drill bit, a drill bit diameter, and a weight-on-bit from the one or more sensors in the drilling operation; use the revolution per minute rate of the drill bit, the drill bit diameter, and the weight-on-bit; and use an artificial neural network.

Example 25 is the non-transitory computer-readable medium of any of examples 21 to 24, wherein the non-transitory computer-readable medium includes instructions for the drill bit subsystem to operate downhole absent communicating with non-downhole systems.

Example 26 is the non-transitory computer-readable medium of any of examples 21 to 25, wherein the instructions are executable to cause the processor to: receive, from a surface of the drilling operation, a set of instructions including an override command for preventing automated procedures from being performed by the machine-teachable module and the control module; and executing the set of instructions to manually control the direction the drill bit.

Example 27 is the non-transitory computer-readable medium of any of examples 21 to 26, wherein the machine-teachable module is teachable prior to being utilized downhole using data stored in a system that is separate from the drill bit subsystem.

Example 28 is the non-transitory computer-readable medium of any of examples 21 to 27, wherein the non-transitory computer-readable medium is in a system that comprises: the drill bit; and the processor.

Example 29 is a method comprising: receiving, by a machine-teachable module that is executed by a processor and positioned with a drill bit downhole, depth data and rate of drill bit penetration from one or more sensors in a drilling operation using the drill bit; determining, by the machine-teachable module, an estimated lithology of a formation at which a drill bit subsystem that includes the drill bit is located; using, by a control module that is executed by the processor and positioned with the drill bit downhole, the estimated lithology to determine an updated location of the drill bit subsystem; and controlling, by the control module, a direction of the drill bit using the updated location and a drill plan.

Example 30 is the method of example 29, wherein the estimated lithology includes an entrance and an exit with respect to a type of formation, the entrance being located at a first layer of the type of formation and proximate to a preceding type of formation, and the exit being located at a second layer of the type of formation and proximate to a subsequent type of formation, the preceding type of formation and subsequent type of formation having a different lithology than the type of formation.

Example 31 is the method of example 30, wherein determining an estimated lithology of a formation at which the drill bit subsystem is located further includes determining the entrance and the exit of the type of formation in response to a change in depth data and rate of drill bit penetration received from the one or more sensors in the drilling operation.

Example 32 is the method of any of examples 29 to 31, further comprising: receiving, by the machine-teachable module, a revolution per minute rate of the drill bit, a drill bit diameter, and a weight-on-bit from the one or more sensors in the drilling operation; using the revolution per minute rate of the drill bit, the drill bit diameter, and the weight-on-bit; and using an artificial neural network.

Example 33 is the method of any of examples 29 to 32, further comprising: operating the drill bit subsystem downhole absent communicating with non-downhole systems.

Example 34 is the method of any of examples 29 to 33, further comprising: receiving, by the control module, a set of instructions including an override command from a surface of the drilling operation for preventing automated procedures from being performed by the machine-teachable module and the control module; and executing the set of instructions to manually control the direction the drill bit.

Example 35 is the method of any of examples 29 to 34, wherein the machine-teachable module is teachable prior to being utilized downhole using data stored in a system that is separate from the drill bit subsystem.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A drill bit subsystem comprising:

a drill bit;

a processor; and a non-transitory computer-readable medium for storing instructions and for being positioned downhole with the drill bit, the instructions comprising:

a machine-teachable module that is executable by the processor to:

receive basin data about offset wellbores and real-time data about a drilling operation that includes the drill bit subsystem, the real-time data including depth data and rate of drill bit penetration from one or more sensors in the drilling operation;

train a lithology estimation model using the real-time data and attributes usable for determining an estimated lithology; and determine, by applying the lithology estimation model to the basin data, the estimated lithology of a formation at which the drill bit subsystem is located; and a control module that is executable by the processor to:

determine, using the estimated lithology, a location of the drill bit in the formation;

compare the location of the drill bit to a planned trajectory of the drill bit for determining whether a trajectory of the drill bit corresponds to the planned trajectory; and control, based on comparing the location of the drill bit to the planned trajectory of the drill bit, the trajectory of the drill bit using the location of the drill bit and a drill plan that includes the planned trajectory of the drill bit.

2. The drill bit subsystem of claim 1, wherein the estimated lithology includes an entrance and an exit with respect to a type of formation, the entrance being located at a first layer of the type of formation and proximate to a preceding type of formation, and the exit being located at a second layer of the type of formation and proximate to a subsequent type of formation, the preceding type of formation and subsequent type of formation having a different lithology than the type of formation.

3. The drill bit subsystem of claim 2, wherein the machine-teachable module that is executable by the processor to determine an estimated lithology of a formation at which the drill bit subsystem is located is further executable to:

determine the entrance and the exit of the type of formation in response to a change in depth data and rate of drill bit penetration received from the one or more sensors in the drilling operation.

4. The drill bit subsystem of claim 1, wherein the non-transitory computer-readable medium includes instructions for the machine-teachable module to be executable to further:

receive a revolution per minute rate of the drill bit, a drill bit diameter, and a weight-on-bit from the one or more sensors in the drilling operation; and use an artificial neural network.

5. The drill bit subsystem of claim 1, wherein the non-transitory computer-readable medium includes instructions for the drill bit subsystem to operate downhole absent communicating with non-downhole systems.

6. The drill bit subsystem of claim 1, wherein the instructions of the non-transitory computer-readable medium are executable to cause the processor to:

receive, from a surface of the drilling operation, a set of instructions including an override command for preventing automated procedures from being performed by the machine-teachable module and the control module; and executing the set of instructions to manually control the trajectory of the drill bit.

7. The drill bit subsystem of claim 1, wherein the machine-teachable module is teachable prior to being utilized downhole using data stored in a system that is separate from the drill bit subsystem.

8. A non-transitory computer-readable medium for storing instructions and being positioned downhole with a drill bit, the instructions comprising:

a machine-teachable module that is executable by a processor to:

receive basin data about offset wellbores and real-time data about a drilling operation that includes a drill bit subsystem, the real-time data including depth data and rate of drill bit penetration from one or more sensors in the drilling operation;

train a lithology estimation model using the real-time data and attributes usable from determining an estimated lithology; and determine, by applying the lithology estimation model to the basin data, the estimated lithology of a formation at which the drill bit subsystem is located; and a control module that is executable by the processor to:

determine, using the estimated lithology, a location of the drill bit in the formation:

compare the location of the drill bit to a planned trajectory of the drill bit for determining whether a trajectory of the drill bit corresponds to the planned trajectory; and control, based on comparing the location of the drill bit to the planned trajectory of the drill bit, the trajectory of the drill bit of the drill bit subsystem using the location and a drill plan that includes the planned trajectory of the drill bit.

9. The non-transitory computer-readable medium of claim 8, wherein the estimated lithology includes an entrance and an exit with respect to a type of formation, the entrance being located at a first layer of the type of formation and proximate to a preceding type of formation, and the exit being located at a second layer of the type of formation and proximate to a subsequent type of formation, the preceding type of formation and subsequent type of formation having a different lithology than the type of formation.

10. The non-transitory computer-readable medium of claim 9, wherein the machine-teachable module that is executable by the processor to determine an estimated lithology of a formation at which the drill bit subsystem is located is further executable to:

determine the entrance and the exit of the type of formation in response to a change in depth data and rate of drill bit penetration received from the one or more sensors in the drilling operation.

11. The non-transitory computer-readable medium of claim 8, wherein the non-transitory computer-readable medium includes instructions for the machine-teachable module to:

receive a revolution per minute rate of the drill bit, a drill bit diameter, and a weight-on-bit from the one or more sensors in the drilling operation;

use the revolution per minute rate of the drill bit, the drill bit diameter, and the weight-on-bit; and use an artificial neural network.

12. The non-transitory computer-readable medium of claim 8, wherein the non-transitory computer-readable medium includes instructions for the drill bit subsystem to operate downhole absent communicating with non-downhole systems.

13. The non-transitory computer-readable medium of claim 8, wherein the instructions are executable to cause the processor to:

receive, from a surface of the drilling operation, a set of instructions including an override command for preventing automated procedures from being performed by the machine-teachable module and the control module; and executing the set of instructions to manually control the trajectory of the drill bit.

14. A method comprising:

receiving, by a machine-teachable module that is executed by a processor and positioned with a drill bit downhole, basin data about offset wellbores and real-time data about a drilling operation that includes the drill bit, the real-time data including depth data and rate of drill bit penetration from one or more sensors in the drilling operation using the drill bit;

training, by the machine-teachable module, a lithology estimation model using the real-time data and attributes usable from determining an estimated lithology;

determining, by the machine-teachable module and by applying the lithology estimation model to the basin data, the estimated lithology of a formation at which a drill bit subsystem that includes the drill bit is located;

determining, by a control module that is executed by the processor and positioned with the drill bit downhole, a location of the drill bit of the drill bit subsystem;

comparing, by the control module, the location of the drill bit to a planned trajectory of the drill bit for determining whether a trajectory of the drill bit corresponds to the planned trajectory; and controlling, by the control module and based on comparing the location of the drill bit to the planned trajectory of the drill bit, the trajectory of the drill bit using the location and a drill plan that includes the planned trajectory of the drill bit.

15. The method of claim 14, wherein the estimated lithology includes an entrance and an exit with respect to a type of formation, the entrance being located at a first layer of the type of formation and proximate to a preceding type of formation, and the exit being located at a second layer of the type of formation and proximate to a subsequent type of formation, the preceding type of formation and subsequent type of formation having a different lithology than the type of formation.

16. The method of claim 15, wherein determining an estimated lithology of a formation at which the drill bit subsystem is located further includes determining the entrance and the exit of the type of formation in response to a change in depth data and rate of drill bit penetration received from the one or more sensors in the drilling operation.

17. The method of claim 14, further comprising:

receiving, by the machine-teachable module, a revolution per minute rate of the drill bit, a drill bit diameter, and a weight-on-bit from the one or more sensors in the drilling operation;

using the revolution per minute rate of the drill bit, the drill bit diameter, and the weight-on-bit; and using an artificial neural network.

18. The method of claim 14, further comprising:

operating the drill bit subsystem downhole absent communicating with non-downhole systems.

19. The method of claim 14, further comprising:

receiving, by the control module, a set of instructions including an override command from a surface of the drilling operation for preventing automated procedures from being performed by the machine-teachable module and the control module; and executing the set of instructions to manually control the trajectory of the drill bit.

20. The method of claim 14, wherein the machine-teachable module is teachable prior to being utilized downhole using data stored in a system that is separate from the drill bit subsystem.

* * * * *